US007122092B2

(12) United States Patent
Poole et al.

(10) Patent No.: US 7,122,092 B2
(45) **Date of Patent: *Oct. 17, 2006**

(54) LABEL APPLICATION APPARATUS AND METHOD OF OPERATION THEREOF

(75) Inventors: Shawn Poole, Riverview, FL (US); Steve Guindine, Temple Terrace, FL (US)

(73) Assignee: Backward Integration, Inc., Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/845,244

(22) Filed: May 14, 2004

(65) Prior Publication Data

US 2004/0206461 A1 Oct. 21, 2004

Related U.S. Application Data

(63) Continuation-in-part of application No. 10/762,307, filed on Jan. 23, 2004.

(60) Provisional application No. 60/446,551, filed on Feb. 12, 2003.

(51) Int. Cl.
*B65C 9/26* (2006.01)
*B65C 9/28* (2006.01)
*B65C 9/42* (2006.01)

(52) U.S. Cl. ..... 156/277; 156/64; 156/249; 156/361; 156/378; 156/387; 156/540; 156/541; 156/DIG. 1; 156/DIG. 37; 156/DIG. 38; 156/DIG. 44; 156/DIG. 45

(58) Field of Classification Search ..... 156/64, 156/249, 277, 351, 356, 361, 378, 384, 386, 156/387, 540, 541, 542, DIG. 1, DIG. 24, 156/DIG. 33, DIG. 38, DIG. 44
See application file for complete search history.

(56) References Cited

U.S. PATENT DOCUMENTS

| | | | | |
|---|---|---|---|---|
| 3,093,528 | A * | 6/1963 | Reich | 156/285 |
| 3,301,733 | A * | 1/1967 | West et al. | 156/363 |
| 3,329,550 | A * | 7/1967 | Kucheck | 156/285 |
| 3,436,294 | A * | 4/1969 | Marano | 156/351 |

(Continued)

FOREIGN PATENT DOCUMENTS

GB 2 139 180 A 4/1983

(Continued)

*Primary Examiner*—Melvin Mayes
(74) *Attorney, Agent, or Firm*—Sunit Talapatra; Foley & Lardner LLP

(57) ABSTRACT

An apparatus and method for applying labels to products of various sizes employs a printer and applicator head using air as a propellant. Control circuitry responsive to sensors located on the apparatus position the labels on the applicator head and trigger the ejection of a label onto a target surface. Labels to be printed are continuously supplied to the printer and applicator head from a label supply strip wound on a label feed reel mounted on the apparatus. The portion of the label liner extending between the feed reel and take-up reel is provided with a detector which can detect a lag in liner tension and activate the take-up reel to restore tension each time a lag condition is detected.

20 Claims, 13 Drawing Sheetse

U.S. PATENT DOCUMENTS

| | | | | | |
|---|---|---|---|---|---|
| 3,483,059 | A | * | 12/1969 | Dinter | 156/364 |
| 3,645,832 | A | * | 2/1972 | Sauer | 156/541 |
| 3,682,743 | A | * | 8/1972 | Cleary et al. | 156/384 |
| 3,888,725 | A | | 6/1975 | French | 156/556 |
| 3,984,277 | A | * | 10/1976 | French et al. | 156/497 |
| 4,295,915 | A | * | 10/1981 | Sakaguchi et al. | 156/361 |
| 4,526,648 | A | * | 7/1985 | Tochtermann | 156/497 |
| 4,556,443 | A | * | 12/1985 | Moya | 156/356 |
| 4,612,079 | A | | 9/1986 | Ostrow | 156/497 |
| 4,676,859 | A | * | 6/1987 | Cleary et al. | 156/361 |
| 4,680,082 | A | * | 7/1987 | Kearney | 156/497 |
| 5,470,420 | A | * | 11/1995 | Yokajty | 156/566 |
| 5,753,072 | A | * | 5/1998 | Taylor | 156/493 |
| 5,853,530 | A | | 12/1998 | Allen | 156/541 |
| 5,971,051 | A | * | 10/1999 | Crankshaw | 156/541 |
| 6,024,149 | A | * | 2/2000 | Bernhard et al. | 156/497 |
| 6,199,614 | B1 | * | 3/2001 | Snyder et al. | 156/387 |
| 6,220,330 | B1 | * | 4/2001 | O'Brien, Jr. | 156/556 |
| 6,368,446 | B1 | * | 4/2002 | McNestry | 156/247 |
| 6,378,590 | B1 | * | 4/2002 | Allen et al. | 156/542 |
| 6,668,896 | B1 | * | 12/2003 | Granero Tormo | 156/556 |
| 2004/0154749 | A1 | * | 8/2004 | Rice | 156/363 |
| 2004/0159402 | A1 | * | 8/2004 | Poole et al. | 156/384 |

FOREIGN PATENT DOCUMENTS

| | | | |
|---|---|---|---|
| GB | 2 168 683 | A | 9/1984 |
| GB | 2 291 856 | * | 2/1996 |

* cited by examiner

LABEL APPLICATION APPARATUS AND METHOD OF OPERATION THEREOF

PRIORITY

This application is a continuation-in-part of non-provisional U.S. patent application entitled, "Label Application Apparatus and Method of Operation Thereof", filed Jan. 23, 2004, having Ser. No. 10/762,307, which claims priority to provisional U.S. patent application Ser. No. 60/446,551, filed Feb. 12, 2003, the disclosures of which is hereby incorporated herein by their entirety by reference.

FIELD OF THE INVENTION

The present invention relates generally to the field of automatic label application. More particularly, the present invention relates to various systems and methods for automatically applying labels to a target surface using air as a propellant.

BACKGROUND OF THE INVENTION

Automatic labeling machinery is known in the art as providing the ability to dynamically apply labels to various packages or products. Typically, labels are transferred onto a surface by first mechanically peeling the label from a backing strip reel and adhering the label to a label holding grid by a temporary vacuum. As a surface of a package passes within a few inches from the label holding grid, an air blast from the label holding grid transports the label to the surface. After transference, the label is securely affixed to the surface by physically pressing the label onto the surface by using a rubber wheel, or a cushioned pad, etc.

Concomitant with the ability to transfer a label to a surface, conventional labeling machinery systems usually affix the label to a rapidly moving surface of an arbitrarily shaped package being transported on a conveyor belt. To accommodate the various package sizes, a conventional labeling system is usually situated at a fixed section of the conveyor belt and either the labeling device or the target package is mechanically displaced to provide the appropriate label-to-surface proximity. Since there are innumerable methods for moving the labeling device and/or target package, these methods are not discussed herein with any particularity.

Notwithstanding the above, it is generally known that conventional labeling systems are prone to mis-transference or mis-targeting errors as the speed of the conveyor is increased or when the label-to-surface proximity exceeds 3–4 inches. Also, the inertial weight of the labeling device and its form factor are known to present operational difficulties during movement. Additionally, label liner flow path, control of the reel take-up and various other aspects of label registration, air blast control, etc., are known to present difficulties which are often not well addressed in conventional systems.

Accordingly, there has been a need for automatic labeling methods and systems which address aspects of the above and other deficiencies in the conventional art.

SUMMARY OF THE INVENTION

It is therefore a feature and advantage of the present invention to provide a labeling application system for transferring labels from a liner onto a target surface, comprising a label printer, a label applicator assembly having at least an air-directing manifold and an applicator head having an angled surface, a feed reel for supplying a label provided on a liner to the printer, and a take-up reel for spooling an expended liner having tension between the feed reel and the take-up reel. The application system may further comprise a detector to determine the tension in the liner and further comprise a motor operably coupled to the take-up reel. The motor can be controlled or activated when the detector determined tension drops below a predetermined level. The detector may comprise a dancer arm and an optic sensor or any other mechanical sensor. Some embodiments may comprise printers available from SATO® or DataMax® Corporation. The feed reel may optionally comprise a latch to securely hold the labels onto the feed reel. The latch may have a locked position and an unlocked position. Air from an air supply may be controlled by a solenoid which, in turn, can be controlled by a second sensor. In some embodiments, the applicator head has two angled surfaces joining at a midpoint of a face of the applicator head and forms an angle of approximately 170 degrees.

In other embodiments, a method for using air to transfer labels from a liner onto a target surface is provided, comprising providing a label on a label liner to a printer from a feed reel, printing a label on a label printer, positioning a label applicator assembly over a target surface, the applicator assembly having at least an air-directing manifold and an applicator head having an angled surface, transferring the label from the liner to the target surface using applicator head directed air; and spooling the expended liner on a take-up reel, the liner having a tension between the feed reel and the take-up reel. The method may also comprise detecting the tension between the feed reel and the take-up reel, and/or activating a motor operably coupled to the take-up reel, when the detected tension drops below a predetermined threshold. In some embodiments, the applicator head has two angled surfaces joining at a midpoint of a face of the applicator head and forms an angle of approximately 170 degrees.

In yet other embodiments of the present invention, a labeling application system for transferring labels from a liner onto a target surface is provided, comprising a printing means for printing on a label, an applicator means for applying a label onto a target surface using air as a propellant, the applicator means having at least an air-directing means for directing air to an applicator head means having an angled surface, a label supplying means for supplying labels on a liner to the printer, and a liner take-up means for spooling the expended liner having tension between the feed reel and the take-up reel. The system may also further comprise an supply means for supplying air to the applicator means and/or a detector means to detect the tension between the feed reel and the take-up reel. The label application system may also include a drive means for driving the take-up reel, the drive means being operably coupled to the take-up reel and being activated when the detector means detects a tension drop below a predetermined threshold. In some embodiments, the applicator head means has two angled surfaces joining at a midpoint of a face of the applicator head means and forms an angle of approximately 170 degrees. The label supplying means may be a feed reel having a foot print, and the liner take-up means may be a take-up reel having a foot print, and wherein the feed reel footprint overlaps with the take-up reel footprint. The label supplying means may further comprise a latching means to securely hold the labels onto label supplying means. The label printing means may be a SATO® printer or a DataMax® printer. In other embodiments, the application system may incorporate an air baffling means for scattering air through the applicator head means.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE DRAWINGS

DETAILED DESCRIPTION OF THE INVENTION

Figure 1:
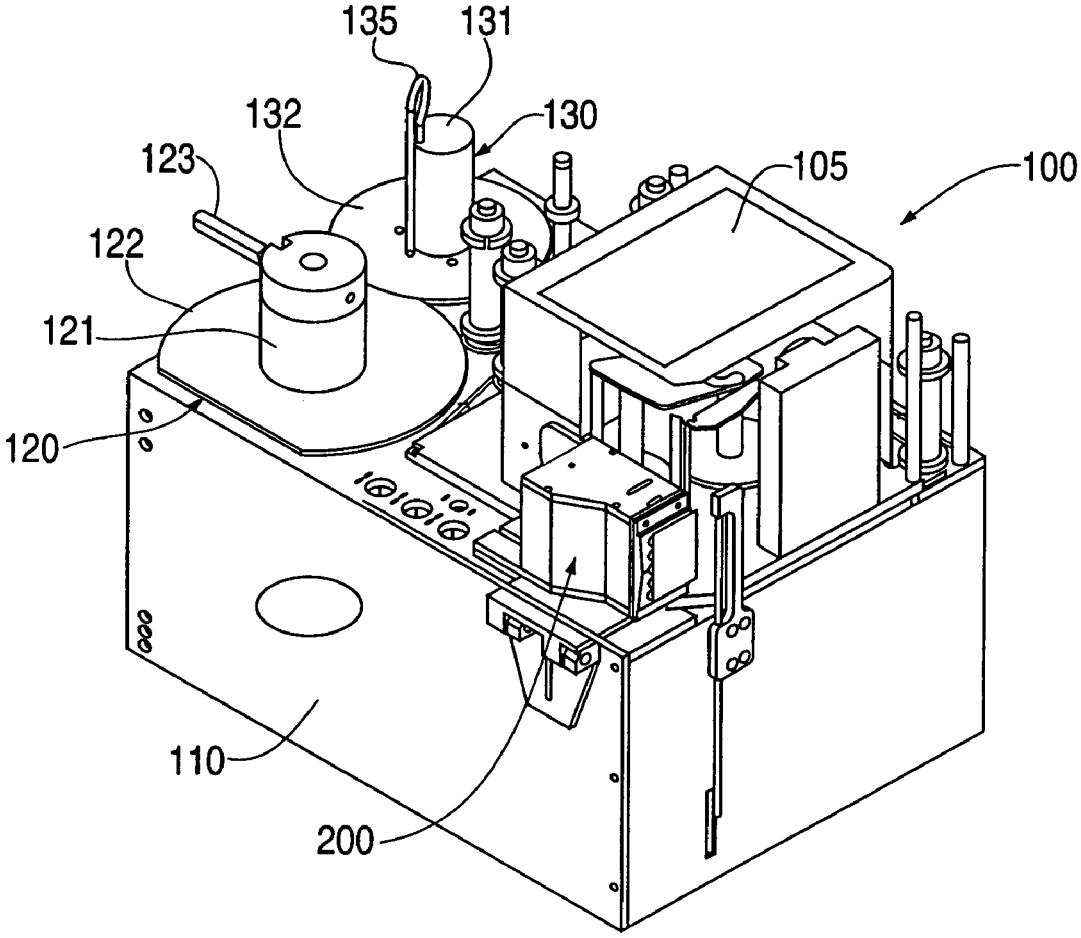
FIGS. 1–3 are perspective views illustrating the front and sides of a label applicator according to one embodiment of the invention.

The invention will now be described with reference to the drawing figures in which like reference numerals refer to like parts throughout.

Figure 2:
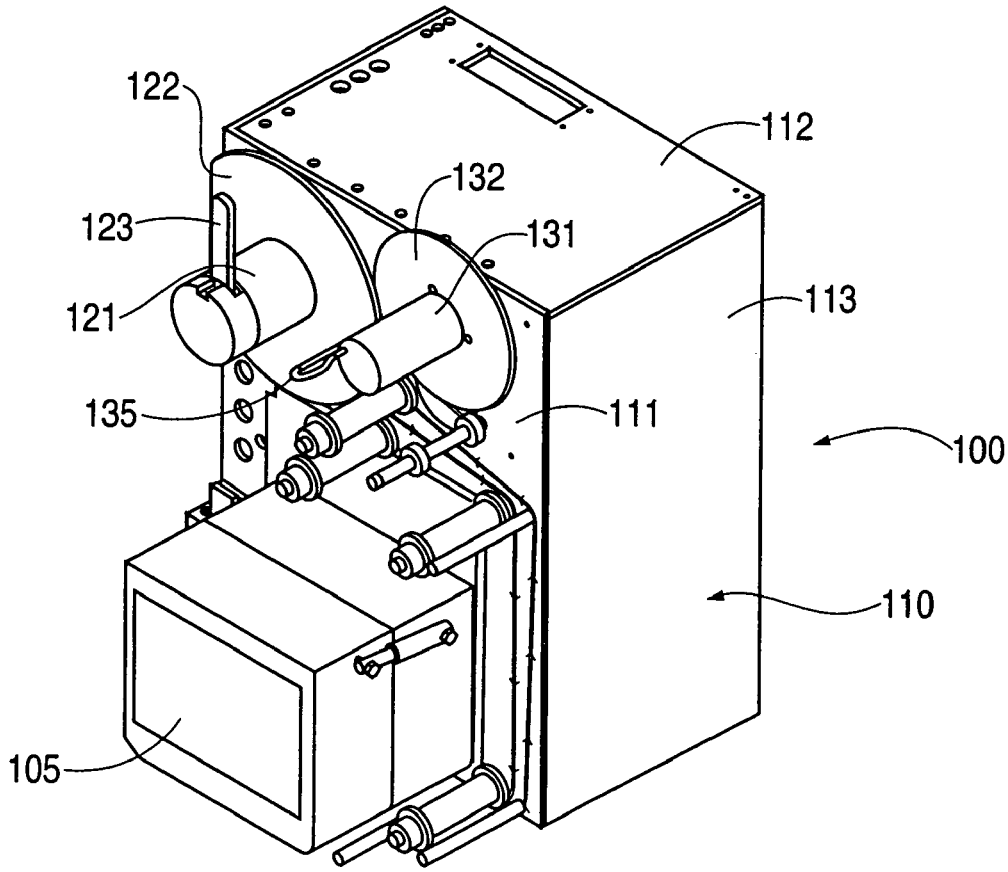
Figure 3:
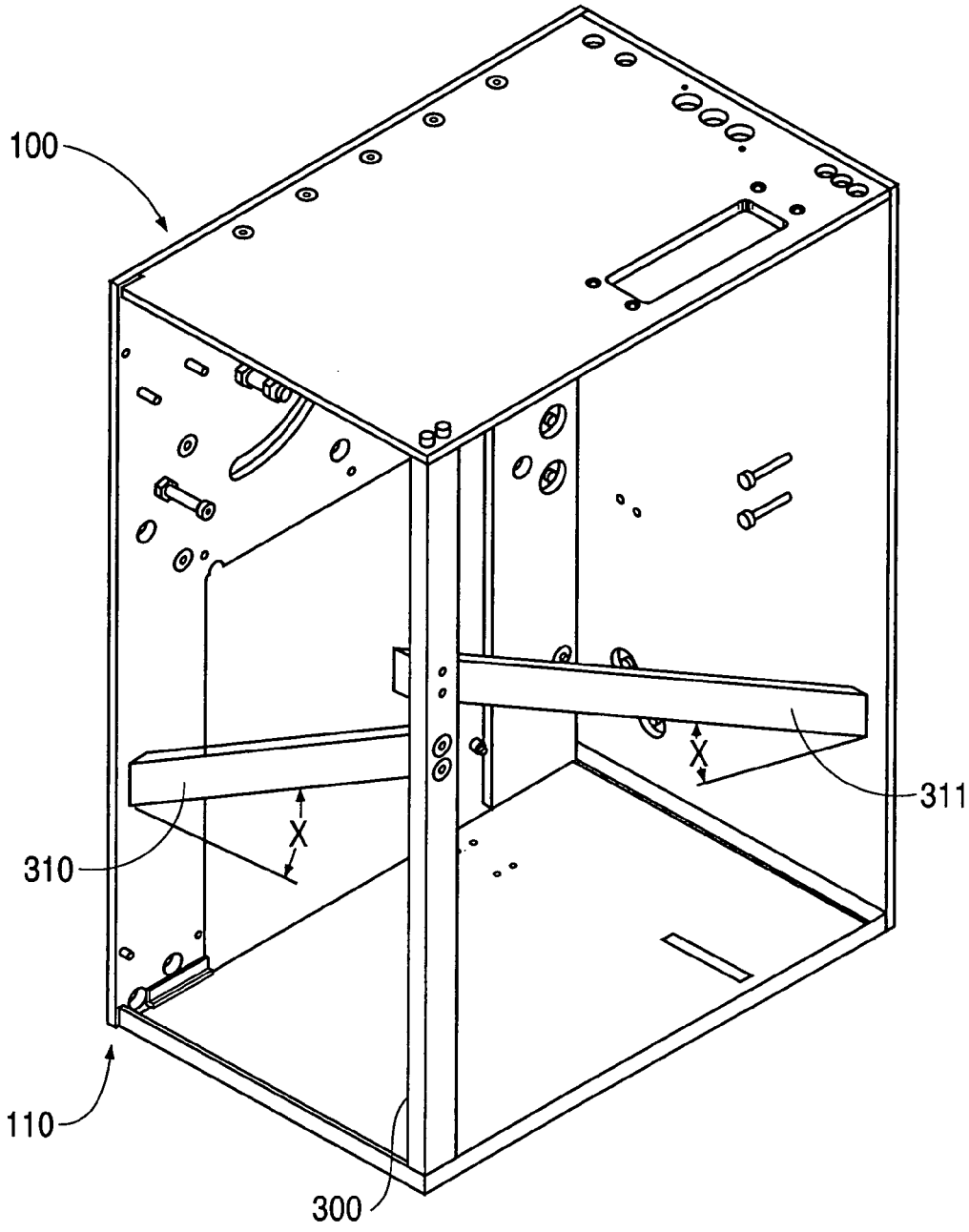

FIGS. 1–5 depict various perspective and side views of one exemplary embodiment of a label application system 100 in accordance with the instant invention. As shown in FIG. 1, application system 100 comprises a printer 105, a housing 110, and an applicator assembly 200. The housing 110, as shown in FIGS. 1 and 2, comprises a front plate 111, top plate 112, and side plates 113. As depicted, front plate 111 forms two faces of the housing 110. It should be noted, however, that the side plates 113 may comprise a single sheet fashioned to form any one or all of the faces of the housing 110. Alternatively, housing 110 is a cover may comprise only a single face or may include additional plates as according to design preferences.

In some embodiments of the present invention, particularly where the applicator assembly 100 is subject to rapid movement and/or G-forces of 2G or greater, additional support in the housing 110 may be desirable. In the embodiment depicted in FIG. 3, braces have been provided to add further rigidity to the housing 110. The braces may be of any design known in the art and should not be limited to the design shown. Bracing materials may comprise numerous materials, including, for example, metals and plastics. In the exemplary embodiment depicted, metal horizontal braces 300 have been placed along the top and bottom faces of the housing 110. In addition, the horizontal braces 300 are coupled to each other by means of diagonal braces 310 and 311. Diagonal brace 310 and 311 are preferably positioned at an angle X that ranges from about 30 degrees±5 degrees, measured clockwise from one of the horizontal braces 300. In some embodiments, the angle X may be about 30 degrees.

Printer engines are well known in the art and are commercially available and may, for example, in some embodiments, be a Sato® label printer engine (Sato Model No. 8485 SE, Sato Corp., USA) at least one of a thermal transfer or direct thermal printer or a DataMax® printer engine (DataMax Corporation, Orlando, Fla., USA). However, the instant invention is not limited to any one type label printer engine or method of printing, and accordingly, other label printers engines and methods may be adapted for use in the instant invention as desired.

Figure 6:
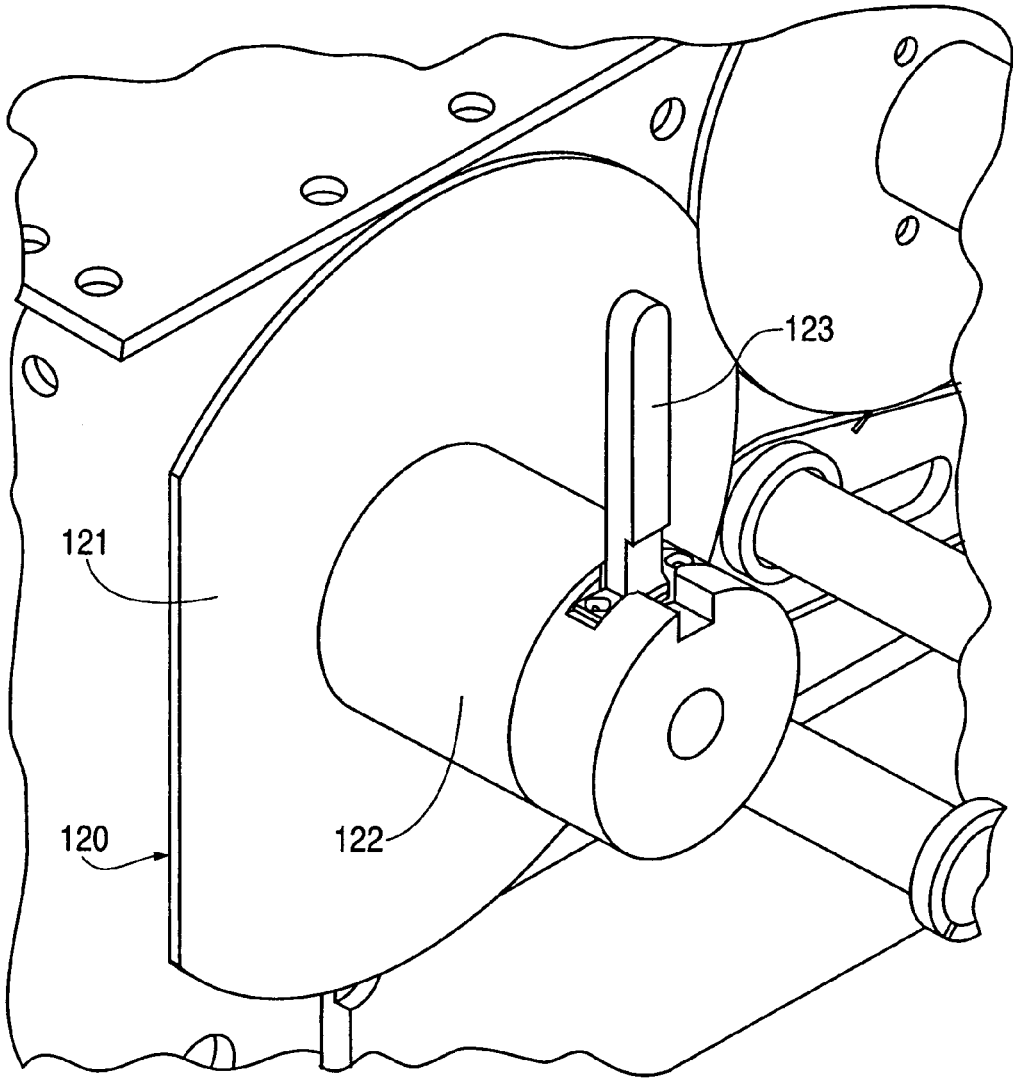
FIGS. 6–7 are isometric views of a feed reel assembly and latching method of a label applicator according to one embodiment of the invention.

Referring now to FIG. 6, a feed reel assembly 120 is provided which comprises a feed reel 121, shield 122, and latch 123. The feed reel assembly 120 is designed to hold a roll of labels to be printed by printer engine 105 and eventually applied to a target surface.

The latch 123 can be used for securing the feed reel 121 to the feed reel assembly 120. The latch 123 can also be used for securing a roll of labels on the reel 121 and provides a relatively convenient method to replace a roll of labels. That is, the shield 122 together with latch 123 provide a guide to keep the rolled label media on the reel 121, and also hinders the movement of the labels from drifting from side to side during rotation of the feed reel 121. The latter advantage of the latch 123 ensures proper alignment, also called "registering", of the labels off the label liner as they exit the roll for printing. To further aid in label registry, preferably, in some embodiments, the latch 123 can be machined under tight tolerances. Tighter tolerances increase the accuracy of registry of the labels because it limits the degrees of movement of the labels off the label liner as they exit the reel. The feed reel assembly 120 may comprise any material known and accepted in the art, including aluminum, stainless steel, plastic, or in combination in some embodiments.

Figure 7:
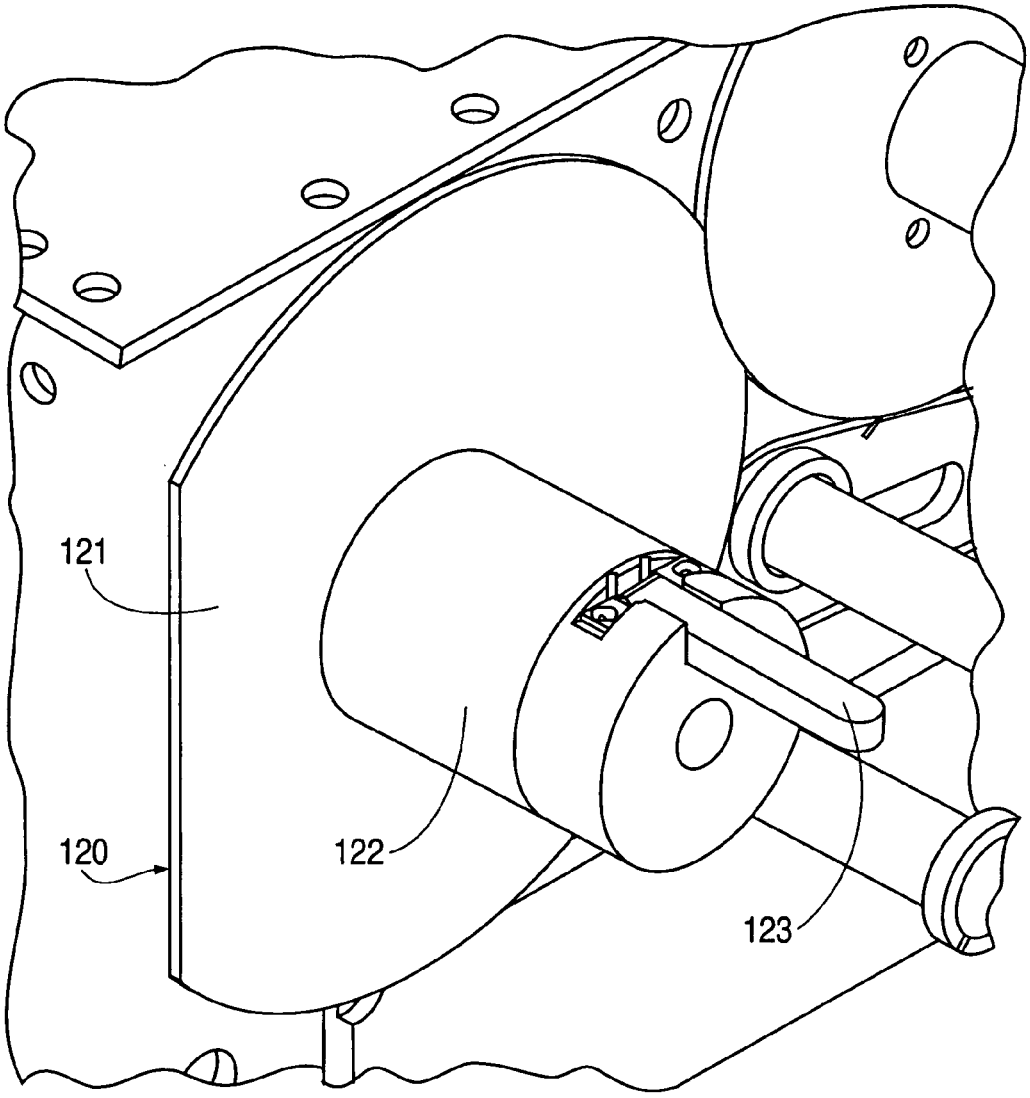

The latch 123 is designed such that, by its operation, the feed reel 121 is releasable. For example, the latch 123 can be mechanically, electronically, or manually lowered to release the feed reel 121 and then can be similarly locked back into position after the new roll core has been replaced. In the exemplary embodiment shown, there are two positions for the latch 123. As depicted in FIG. 6, the latch 123 is in a locked position P1, and the label roll (not shown) is fixed into position and cannot be removed unless the latch 123 is lifted from the locked position with a requisite force. When raised into an unlocked position P2, as depicted in FIG. 7, the latch 123 can then have the capability to pivot 90 degrees to a position parallel with the axis of the reel 121. This unlocked position P2 allows the operator to load a label roll onto the reel 121 relatively easily without any interference from the latch 123. This arrangement also prevents the operator from removing any parts of the feed reel assembly 120 when loading media in applications where the label width is fixed to one dimension.

Figure 8:
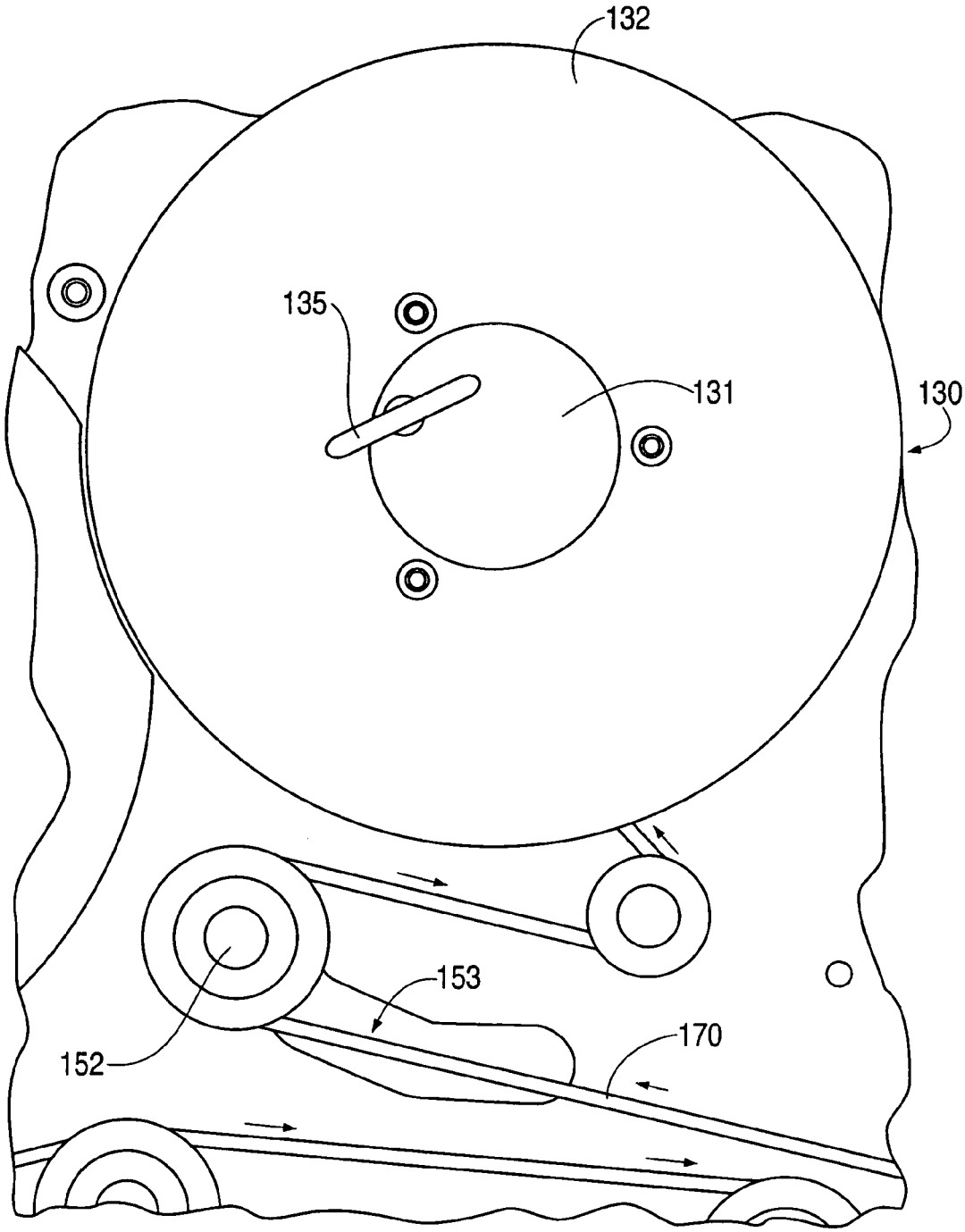
FIG. 8 is a front view of a take-up assembly of a label applicator according to one embodiment of the invention.

FIG. 8 depicts a portion of a path flow 170 for labels. The path flow 170 of the label may be predefined, for example, by applying silkscreen leads to the printer 105. The path flow 170 of the labels may also be silkscreened, for example, with epoxy to the frame in a process to apply a permanent nomenclature without the use of labels and adhesives.

A take-up assembly 130 is designed for collecting the left over media-e.g., label liner-after the printer 105 has printed a label. A take-up reel 131 is mounted to a shaft 133 (as easily seen in FIG. 4) and handles the media liner. Take-up assembly 130 can comprise a shield 132 and a pin 135 (as easily seen in FIG. 8). The shield 132 can aid in the efficient spooling of the expended media liner and the pin 135 can be used as a means to fasten the take-up reel 131 in take-up assembly 130. The pin 135 provides a relatively quick way to release full liner reels by simply removing the pin 135 because it creates a gap between the liner and the take-up reel 131. To enable a more compact arrangement of the roll core space and the take-up space, backplate spaces for the roll core and the take-up are shared. Thus, when there is a full roll of labels on the reel 121, the reel take-up 131 should be empty and vice versa. This arrangement is may be preferable where the machine is to have a relatively small footprint.

Figure 4:
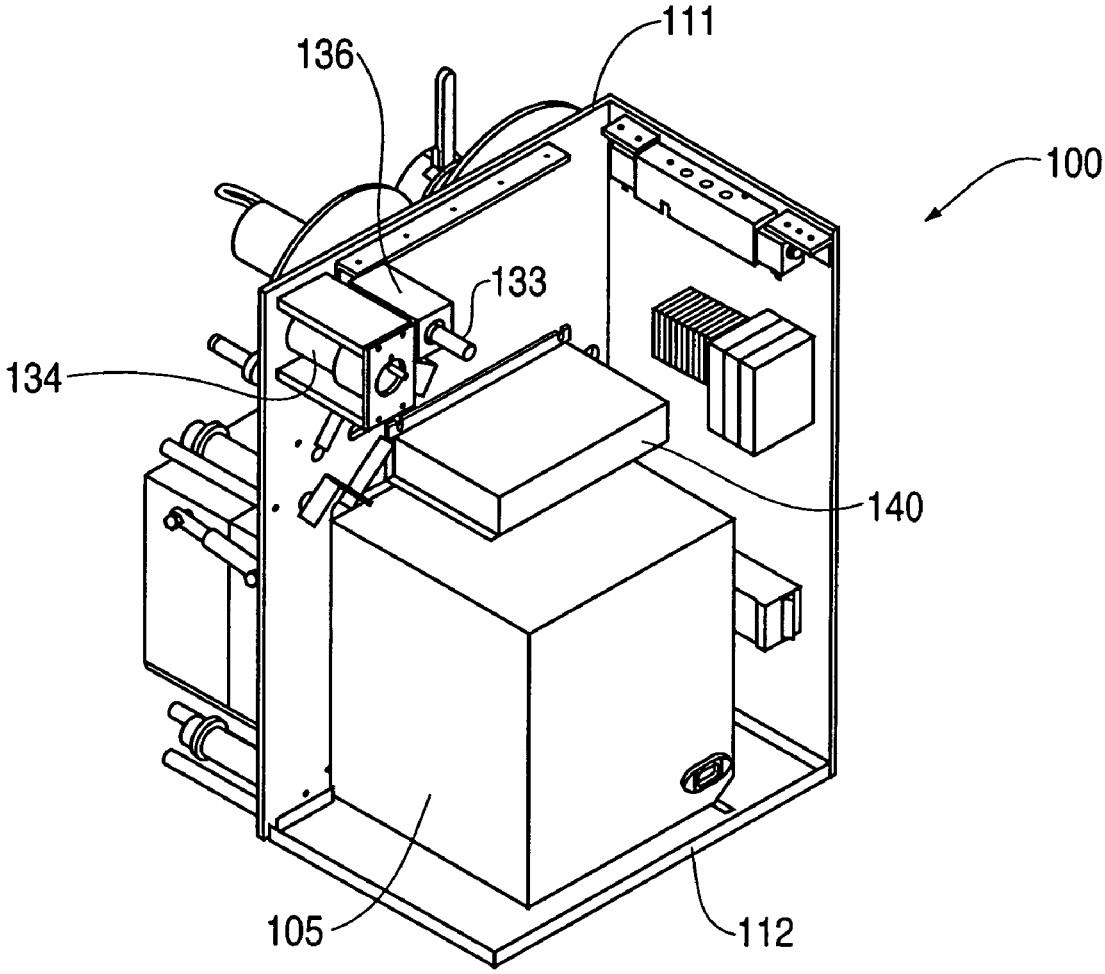
FIGS. 4–5 are perspective views illustrating the back side of a label applicator according to one embodiment of the invention.
Figure 5:
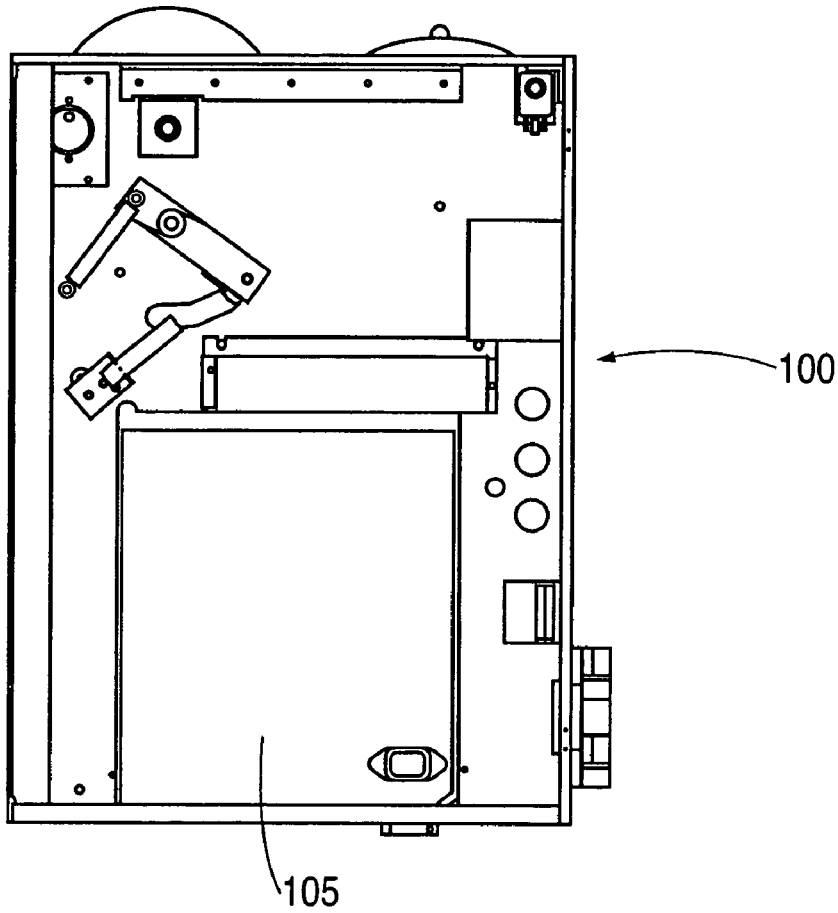

The design of take-up assembly 130 is to collect the expended media liner in the take-up reel 131 by rotating the shaft 133 which is controlled by a motor 134 (as easily seen in FIG. 4). The motor 134, in turn, is activated by the lack of predetermined tension of the expended media liner, as detailed below. The roll of expended media liner is to be discarded each time the operator refills a label stock into the system. A bearing block 136 can be employed with a clutch bearing or one-way mechanism to allow the shaft 133 to turn in one direction only. The assembly, having the clutch bearing, ensures that as the take-up reel 131 gets larger, the take-up reel 131 does not turn back on itself potentially breaking the liner.

Motor 134 can be powered by a power supply 140. In some embodiments, the power supplied is DC which may allow for varying the speed of the take-up reel 131. It may also be preferable, in some embodiments, to provide a means to shut off power to the motor 134 without shutting power to the application system 100. In such an embodiment, the expended liner from the take-up assembly 130 can be replaced without shutting down the entire application system 100.

The activation and regulation of motor 134 may also be controlled by means of control circuitry and/or a mechanical device. One such mechanical means is to employ an arm 150 coupled to circuitry that can control motor 134 activity. The arm 150 may be utilized in the take up design to account for insufficient torque and control due to a standard take up motor. Additionally, the arm 150 can provide tension moderation for the liner strip, thereby reducing mis-alignment or mis-registration.

Figure 9:
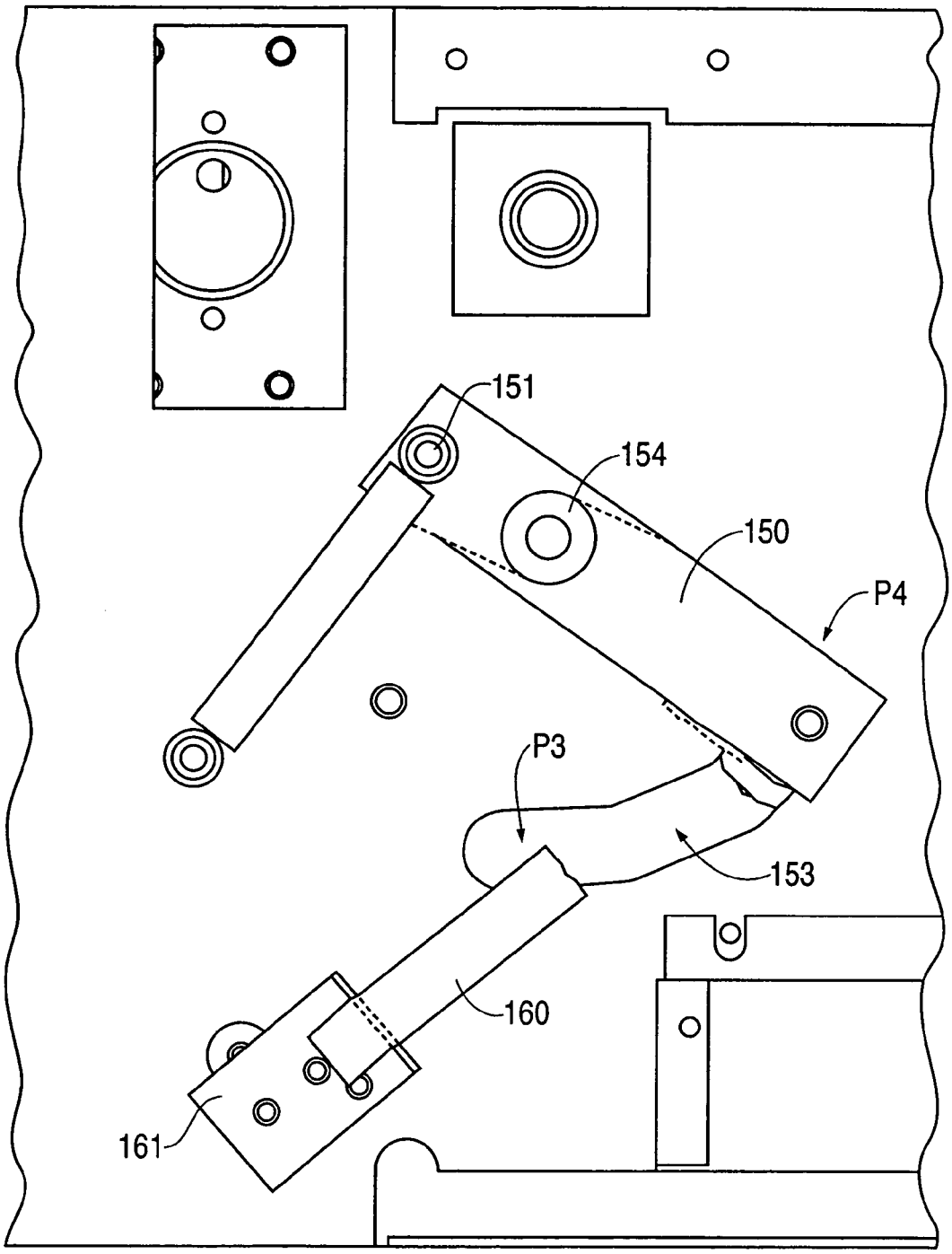
FIG. 9 is a rear view of a take-up assembly of a label applicator according to one embodiment of the invention.

FIGS. 8 and 9 illustrate blow-up front and rear views, respectively, of the take-up assembly 130. The arm 150 is shown as being mounted about a hinge 154 and comprises a roller 152 that guides the arm 150 with a range of motion predetermined by guide hinge 154 to allow the liner to wind through the label applicator and move the arm in a controlled path 153. The arm 150 is tensioned, in some embodiments, with a spring 151 with a tension amount preferably more than the amount needed to move the arm and less than the amount needed to break the liner.

In some embodiments, particularly where the applicator assembly 100 is subject to rapid movement and/or G-forces, the roller 152 may be designed with a larger surface area than that which is required with a stationary applicator assembly. With a larger surface area, the break point of given liner is spread over the entire surface, reducing the chances for tearing or breaking. In some embodiments, the roller 152 has a surface area of about 9 $in^2$±25%, and preferably about 9.4 $in^2$.

In the exemplary embodiment shown in FIG. 9, the arm 150 is attached to a spring mechanism 151 that disposes the arm 150 to a home position (designated P4) nearest a sensor 160, shown affixed to the applicator assembly 100 with a mount 161. This position is indicative of a lag or relatively low tension in the liner flow path 170. Conversely, when the arm 150 is in position P3 (not depicted), the sensor 160 sends a signal to activate motor 134. When activated, the motor 134 rolls take-up reel 131 causing the liner to wrap around the take-up reel 131 and introduce tension in a liner flow path 170. Once the arm 150 moves from the home position P4 to position P3, the sensor sends a signal to deactivate the motor 134.

The sensor 160, in addition to the above-described functions, may also be incorporated for registration of the labels. For example, a sensor may detect not only the presence of a label on an applicator head 240 (discussed below in FIG. 10A), but also the position, or alignment, of a label on the applicator head 240. In this way, the sensors 160 may be utilized to improve the accuracy and adjustability of the registration. The increased accuracy of registry improves targeting, for example. The distance the label comes out of the print engine is one component in determining registration and can be selected through engineering efforts or nominal trial-and-error.

Sensor 160 may be a photoelectric sensor in some embodiments but is not limited to any one device or method of signaling. Similarly, signals from sensor 160 may be a low voltage DC signal to a DC-to-DC relay, an AC voltage or an AC/DC current signal, but any number of methods of signaling are known in the art and may be suitable. The signal can be relayed to a Programmable Logic Controller referred to as a PLC. A PLC processes signals and outputs a designated signal, for example a 24V DC signal, which turns the take-up motor on and off. PLCs are often equipped with a microprocessor and ROM and are amenable to programming.

It should also be noted that the sensor 160 need not be placed at position P3, but may be placed at P4 or at any other location. Some embodiments may be equipped with sensors and control circuitry that may not only turn the motor 134 on and off, but also regulate the speed of the motor, relative to the tension in the liner flow path 170 and/or the position of the dancer arm 150.

It should be appreciated from the teachings herein that the application system 100 need not be equipped solely with one sensor 160, but may be equipped with multiple sensors built into the system, such as, for example, a take-up motor run sensor, a label head fiberoptic sensor, and various printer function sensors. Signals from these sensors may be relayed to the PLC for processing via connections or connectors, such as, for example, 24 pin cable connector as is known in the art. Other connection means may be used if desired.

Figure 10A:
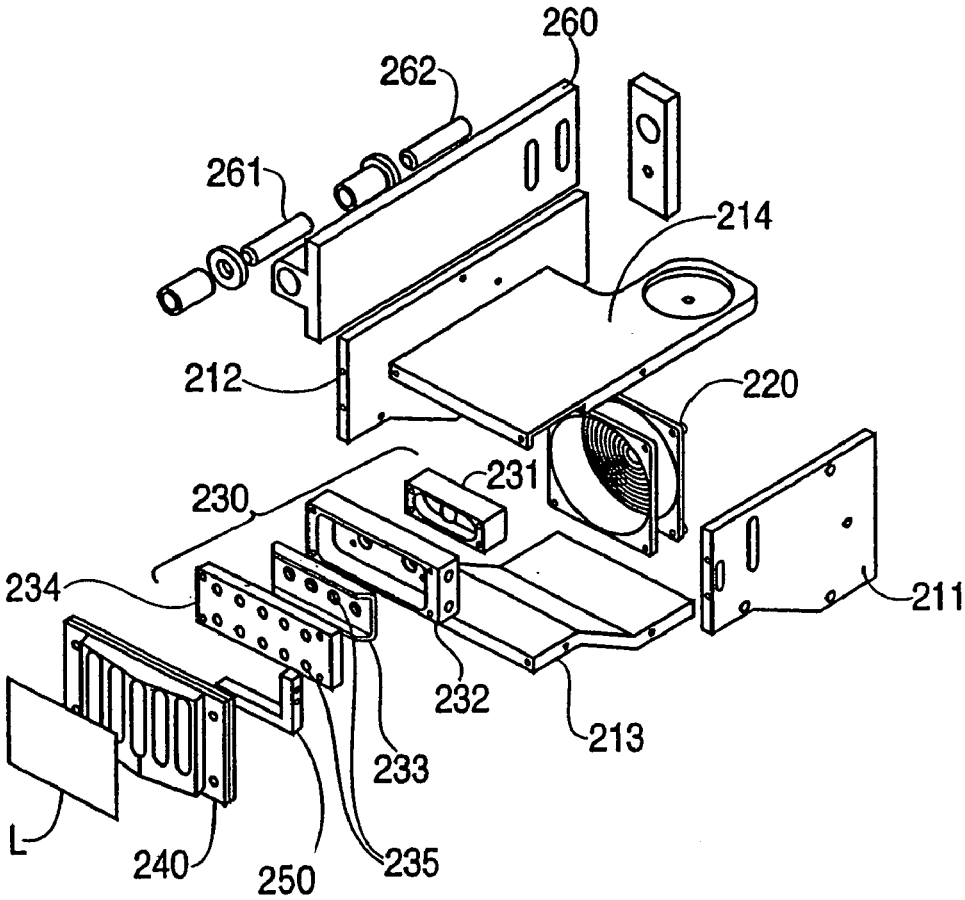
FIGS. 10A and 10B are an exploded view and compressed view of a label applicator according to one embodiment of the invention.
Figure 10B:
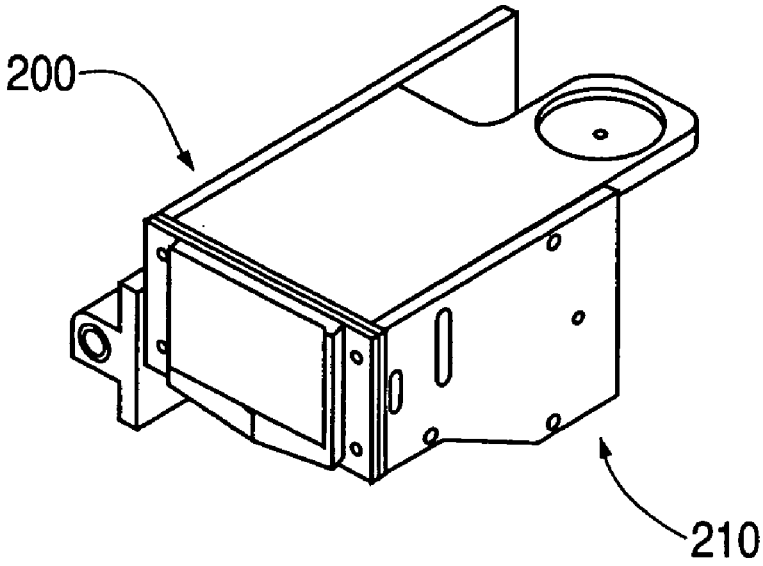

FIGS. 10A and 10B are exploded and compressed views of an exemplary embodiment of an applicator assembly 200 having an enclosure 210 further comprising an outside plate 211, inside plate 212, back plate 213, and a front plate 214. Alternatively, the enclosure 210 may also be a single unit formed from a single sheet or casting material. The enclosure 210 may also be a single unit formed from a single sheet or casting material. The enclosure 210 may be fashioned from any durable materials known in the art such as plastics and metals, for example, aluminum or stainless steel, and may be of any shape amenable to housing a fan 220. The instant invention is not limited to any one model or design of the fan 220. Preferably, in some embodiments, fan 220 is of a DC type.

Figure 11:
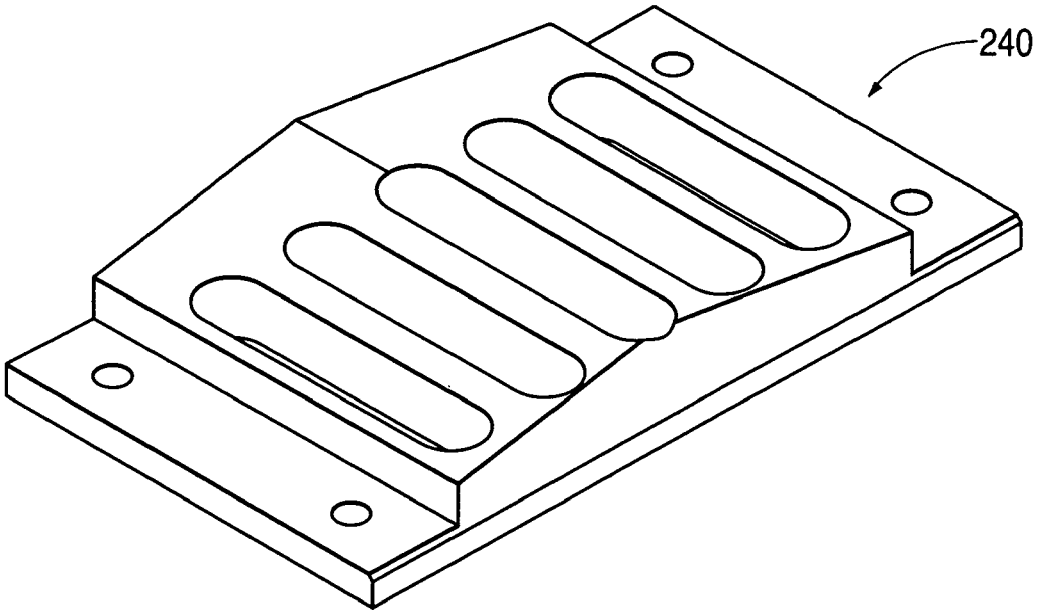
FIG. 11 is an isometric view of a label applicator head according to one embodiment of the invention.
Figure 12:
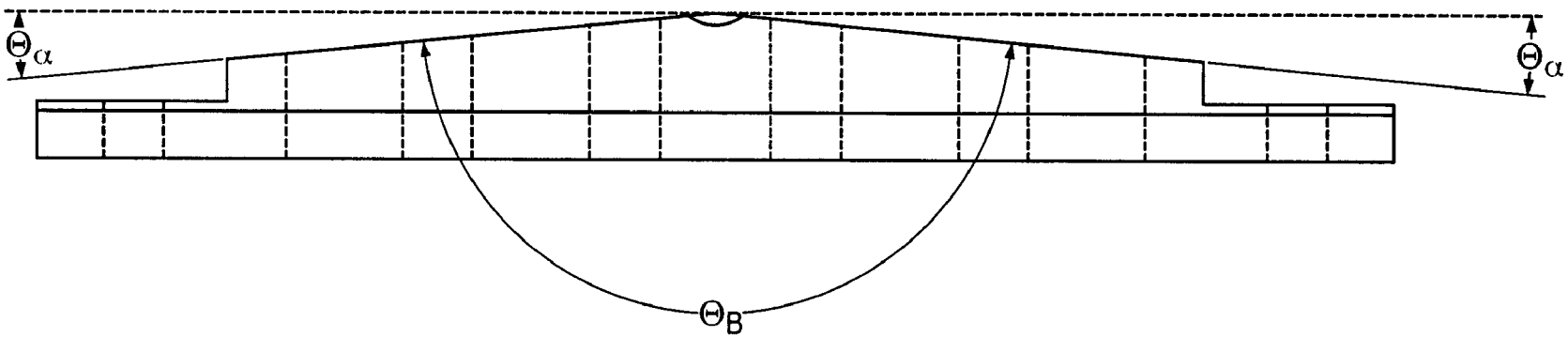
FIG. 12 is a side view of a label applicator head according to one embodiment of the invention.

The fan 220 generates appropriate vacuum through housing 210 to hold the label L onto applicator head 240 until a burst of air ejects the label L. The applicator head may comprise any material, including, but not limited to, Teflon®. Though in some embodiments, the applicator head 240 may have a flat surface, the applicator head 240 may also be designed to incorporate an angle $\theta_\alpha$ from the center as shown in FIGS. 11 and 12. In some embodiments, an angle $\theta_\alpha$ may preferably range from about 3° to about 7°, and more preferably about 5° in other embodiments. In other words, the supplementary angle $\theta_\beta$ is preferably 170°±2°. The term "about" has been incorporated to reflect a margin of error, inherent to such measurements as well as to accommodate allowances for variations due to design objectives.

The multiply angled applicator head 240 in the exemplary embodiments has been demonstrated to better allow synthetic and/or paper labels to break away from the liner which, in turn, aids label registry. It has also been demonstrated that the angled applicator head 240 is better suited to hold or retain a label during movement of the label applicator 200.

Referring back to FIG. 10A, a manifold 230 is designed to direct air flow though the applicator head 240 in a manner to eject and direct the label L to its intended target surface. Any manifold arrangement or combination that is suitable to launch the label L from the applicator head 240 and onto the intended target such that the adhesive surface of the label adheres to the target is within the scope of the instant invention.

In the embodiment shown, the manifold 230 comprises a top plate 231, a center plate 232, a baffle plate 233, and a bottom plate 234. When the solenoid 180 is activated, the flow of the applicator assembly air is designed to enable ushering of the air into the enclosure 210 and into the manifold 230. Air first enters a single air nozzle in the top plate 231 and fills the chamber therein. The air is then channeled through the center plate 232 which comprises two air nozzles, symmetrically positioned in the center plate 232, but not directly over the air nozzle of the top plate 231. This arrangement better allows for indirect and uniform air flow through the manifold 230. Similarly, the air from the center plate 232 is indirectly and evenly scattered through the plurality of air nozzles of baffle plate 233 and air nozzles 235 of the bottom plate 234.

Accordingly, the manifold 230 may be designed for a focally even and uniform distribution of air across the label surface. The uniform distribution of air promotes farther and more accurate labeling of target surfaces from the application system 100. For example, non-uniform bursts or uncentered nozzles can cause the label L to flip or roll and thereby miss the proper location on the target or miss the intended target altogether. Therefore, the center point of the nozzles should be centered on the label L in both directions to minimize errant air flow and maximize predictability and consistency.

It may be desirable, but not necessary, that the applicator assembly 200 have access to a source of clean, constant air flow. A solenoid 180 (easily seen in FIG. 4) may be used to regulate air flow from an air source to the applicator assemble 200. More specifically, the solenoid 180 may be incorporated to distribute adequate air volume to component channels. In some applications, air flow may range from about 1.8 $ft^3$/min. to about 2 $ft^3$/min.

To facilitate proper uniformity, the pneumatics for the applicator assembly 200 may be calibrated for constant pressure control by a regulator so that the flow rate is approximately uniform between air bursts. Maximum flow rate can be determined by a point of restriction. In some cases, the main restriction is the valve solenoid that the system is utilizing. Other restrictions can be bend radii, pneumatic tubing size, flow control settings and the restrictions set prior to the system. Some design factors that may cause the restriction of flow even where unintentionally introduced such as with applicator flow pinch points and air exiting the valve solenoid 180. On pneumatics having a blow bar, the air flow rate is predominantly restricted by the flow control, allowing the user the ability to adjust the flow rate for maximum performance.

A flow rate (Cv) of greater than 0.5 is preferably used when targeting a package in excess of 5 inches away, however, any desired or suitable flow rate may be used. The appropriate flow rate is determined based on the flow rate required to eject the label L from the applicator head 240 onto a target package and the distance there between up to 6–8 inches away from the applicator head 240. Further distances can be achieved according to proper calibration of the flow rate and other associated systems.

The applicator assembly 200 is also equipped with a fiber optic mount plate 250 which is designed to receive a fiber optic device for detection of a label resting on the vacuum plate 240 and to ensure that the label is "registered" for application signal. The fiber optic device may be optionally coupled to a processor which may allow for the proper positioning of the application system 100 relative to the intended label target. The fiber optic device may also be coupled to a triggering device, e.g., a solenoid, to actuate the fan 220 to eject label L. The fan 220 may optionally be turned off and on via a fiber-conveyed signal and also provide vacuum to hold the label onto the vacuum plate 240.

FIG. 10A illustrates a hinge 260, including hinge pins 261 and 262 as one means of affixing applicator assembly 200 to the housing 110 of application system 100. A hinging means of attachment provides a convenient method of removing and replacing applicator assembly 200 to gain access to other parts of the application system, e.g., the printer 105, without detaching the application system 100 entirely. However, it should be understood that other means of both permanent and removable affixation are also suitable, including, but not limited to, bolts, screws and welding, etc.

The exemplary embodiments of this invention may be roll fed or fan fed. In exemplary embodiments having a dynamically moving applicator assembly configuration, the invention enables the mass of the applicator system 100 to be reduced to improve G-force-related problems inherent to a rapidly moving and stopping printer. Roll and take up sizes can also be mitigated to improve performance when the units are moving. Moreover, the path of label flow can be designed to improve flow of the label strip and to normalize the flow path footprint.

Accordingly, it should be appreciated from the teachings herein that various modifications to the exemplary embodiments, such as, for example, flow path alteration, reconfiguration of elements, hingings, etc., may be contemplated without departing from the spirit and scope of this invention. For example, a Centronics plug (or optional out on Data-Max® printers) may be used, coupled to a printer driver circuit signal to turn on the valve feeding blow bar so the air is being used during printing (e.g., SSR Air Assist Signal). Where air requirements are important, a filter regulator with a switch can be added to send out an alarm if the pressure is determined to below a threshold.

Additionally, the type of label and glue may also or modified to further enable the label to be blown accurately 8–10 inches or more, and the capacity of the take up reel 131 may be increased to 8 inches, according to design preferences. In some embodiments, an industry standard 40 lb. liner with paper media may be preferred.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A label application method for using air to transfer labels from a liner onto a target surface, comprising:

providing a label on a label liner to a printer from a feed reel;

printing a label on a label printer;

positioning a label applicator assembly over a target surface, the applicator assembly having at least an air-directing manifold and an applicator head, the applicator head having a surface that forms an angle of about 170±4 degrees at a mid-point of a face of the applicator head;

determining a position of the label on the applicator head;

transferring the label from the liner to the target surface using applicator head directed air; and spooling the expended liner on a take-up reel, the liner having a tension between the feed reel and the take-up reel.

2. The label application method according to claim 1, further comprising:

detecting the tension between the feed reel and the take-up reel.

3. The label application method according to claim 1, further comprising:

activating a motor operably coupled to the take-up reel, when the detected tension drops below a predetermined threshold.

4. The label application method according to claim 3, further comprising:

securing label liner bales to the feed reel with a feed reel latch.

5. The label application method according to claim 1, wherein the label printer utilizes at least one of a thermal transfer or direct thermal printing process.

6. A label application system using air to transfer a label from a label applicator assembly to a target surface, comprising:

a printing means for printing on a label;

an applicator means for applying a label onto a target surface using air as a propellant, the applicator means having at least an air-directing means for directing air to an applicator head means, the applicator head means having a surface that forms an angle of about 170±4 degrees at a mid-point of a face of the applicator head means;

a label registration means for determining a position of the label on the label applicator means;

a label supplying means for supplying labels on a liner to the printer; and a liner take-up means for spooling the expended liner, the expended liner having tension between the feed reel and the take-up reel.

7. The label application system according to claim 6, further comprising:

an air supply means for supplying air to the applicator means.

8. The label application system according to claim 6, further comprising:

a detector means to detect the tension between the feed reel and the take-up reel.

9. The label application system according to claim 6, further comprising:

a drive means for driving the take-up reel, the drive means being operably coupled to the take-up reel and being activated when the detector means detects a tension drop below a predetermined threshold.

10. A label application system for transferring labels from a liner onto a target surface, comprising:

a label printer;

a label applicator assembly, the applicator assembly having at least an air-directing manifold and an applicator head, the applicator head having an angled face of about 170±4 degrees at a mid-point of the face of the applicator head;

a fiber optic label registration sensor;

a feed reel for supplying a label provided on a liner to the printer;

a take-up reel for spooling an expended liner, the liner having tension between the feed reel and the take-up reel;

a liner take-up motor, wherein the take-up motor is operably coupled to the take-up reel;

a clutch, the clutch restricting the take-up reel to turn in only one direction; and a liner tension detector.

11. The label application system according to claim 10, wherein the tension detector is a dancer arm, wherein the position of the dancer arm is detected by a first sensor.

12. The label application system according to claim 11, wherein the first sensor is an optical sensor.

13. The label application system according to claim 12, wherein the take-up motor is activated when the tension in the liner drops below a predetermined level.

14. The label application system according to claim 11, wherein the first sensor is a mechanical sensor.

15. The label application system according to claim 10, wherein the label printer is at least one of a thermal transfer or direct thermal printer.

16. The label application system according to claim 10, wherein the feed reel further comprises:

a latch to securely hold the labels onto the feed reel.

17. The label application system according to claim 16, wherein the latch has a locked position and an unlocked position.

18. The label application system according to claim 10, further comprising:

an air supply, wherein the air supply is controlled by a solenoid.

19. The label application system according to claim 10, further comprising:

a baffle plate, the baffle plate scattering air through the air directing manifold.

20. The label application system according to claim 1, further comprising:

a second sensor capable of controlling the air supply.

* * * * *